US006406310B2

(12) United States Patent
Schmid

(10) Patent No.: US 6,406,310 B2
(45) Date of Patent: Jun. 18, 2002

(54) ELECTRIC PLUG SYSTEM

(75) Inventor: Wolfgang Schmid, Langenargen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/853,272

(22) Filed: May 11, 2001

(30) Foreign Application Priority Data

May 16, 2000 (DE) ..... 100 24 029

(51) Int. Cl.[7] ..... H01R 13/62
(52) U.S. Cl. ..... 439/157; 439/911
(58) Field of Search ..... 439/157, 271–272, 439/372, 911, 34

(56) References Cited

U.S. PATENT DOCUMENTS 5,873,745 A * 2/1999 Duclos et al. ..... 439/372
5,888,081 A * 3/1999 Konoya et al. ..... 439/157
5,913,691 A * 6/1999 Clark et al. ..... 439/157
5,975,928 A * 11/1999 Tsuji ..... 439/157
6,264,485 B1 * 7/2001 Saka et al. ..... 439/157

FOREIGN PATENT DOCUMENTS

DE 297 21 908 U1 3/1998
DE 198 30 672 U1 1/2000
DE 200 00 160 U1 5/2000

* cited by examiner

*Primary Examiner*—Gary F. Paumen
*Assistant Examiner*—Felix O. Figueroa
(74) *Attorney, Agent, or Firm*—Davis & Bujold, P.L.L.C.

(57) ABSTRACT

The electric plug system for the automatic transmission of a motor vehicle consists of a socket situated on the transmission and of a plug engaging in the socket wherein the cylindrical end (10) of the socket that accommodates the plug traverses a bore (3) in the transmission which is placed in the oil pan. The socket has a radial flange (5) to which attaches a cylindrical segment (6) of small diameter followed by the cylindrical end of a diameter still further reduced. The cylindrical end and the cylindrical segment are surrounded by a centering sleeve which by a locking system on the outer side of the oil pan can be firmly connected with the latter.

8 Claims, 7 Drawing Sheets

ELECTRIC PLUG SYSTEM

FIELD OF THE INVENTION

Figure 1:
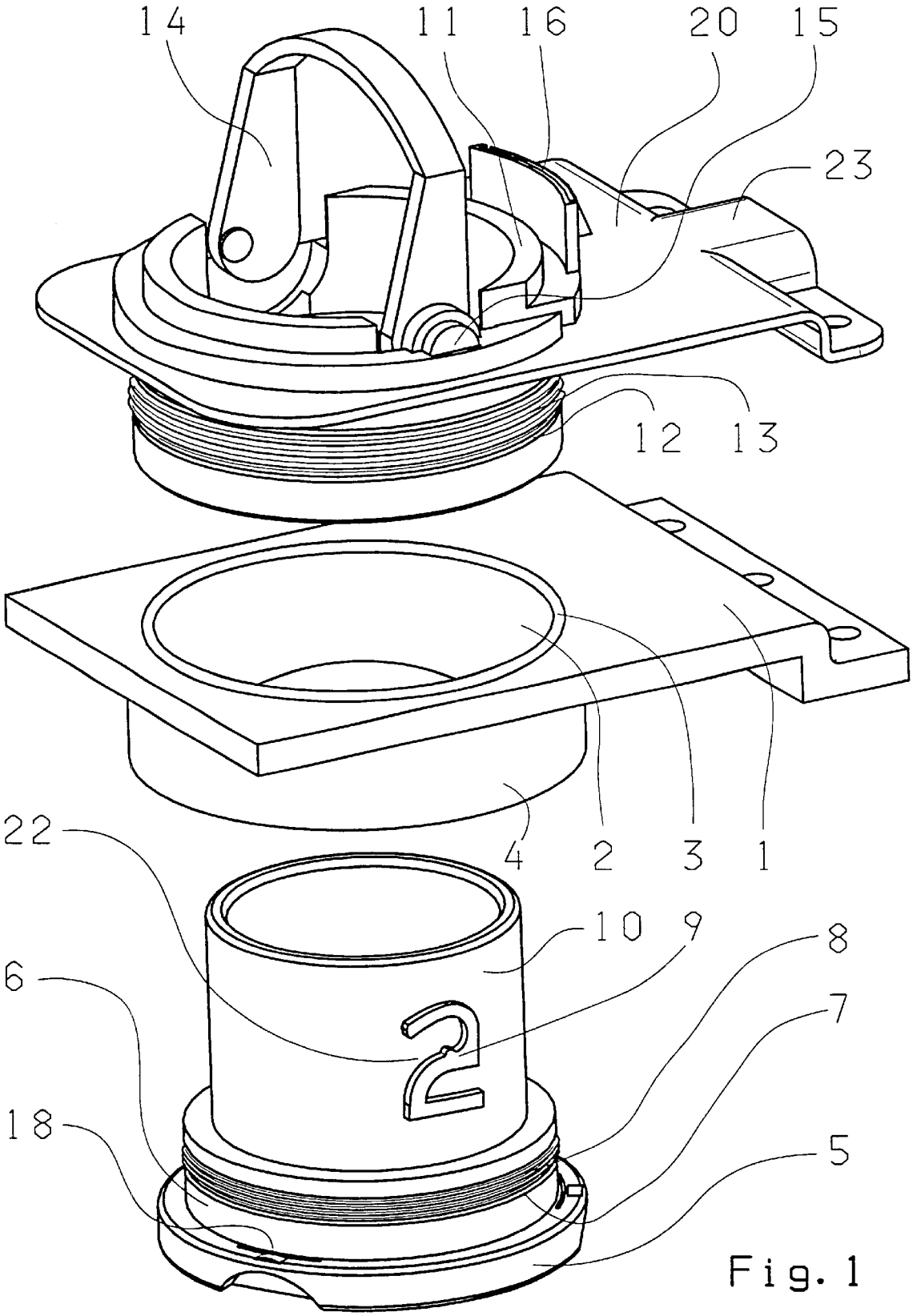

According to the preamble of claim 1, this invention concerns an electric plug system for the automatic transmissions of motor vehicles and consists of a socket and a plug that engages in the socket to create a connection between the electronic transmission control device situated in the transmission and the electric feed lines integrated in the wire harness of the motor vehicle.

BACKGROUND OF THE INVENTION

Automatic transmissions for motor vehicles such as have been manufactured in large numbers by the Applicant have an electronic transmission control device or an electrohydraulic control often provided with an electronic module which is to be connected with a cable harness situated outside the transmission. The electric feed lines in the proximity of the electronic module within the transmission can be designed as flat lines connected, for example, with a socket of the electronic transmission control which is placed in the transmission housing after which the electric connection to the vehicle cable harness is created by plugging a matching plug.

The transmission wall usually is, at the same time, the dividing wall between the transmission control situated within the transmission housing and connected with a socket carrying electric contacts which is inserted in the transmission wall. The matching plug which is plugged in the socket is connected in circuit with the inputs and outputs of a control electronic system for monitoring and controlling the electronic system contained in the automatic transmission.

An electric plug system for the automatic transmissions of motor vehicles has been disclosed in DE U 297 21 908. In this plug system, the plug part is part of an electric plate from which the electric plug contacts pointedly project toward the wall of the transmission.

The plug contact arrangement is delimited by a web-like enclosing edge. The enclosing edge forms a seat for the front section of the plug socket part and for accommodating a guide sleeve. The guide sleeve is disposed projecting support and the locking device. The locking device is movably disposed on the plug part for advancing the locking stop.

Even though it is thereby possible with simple means to obtain a tension-free assembly with simultaneous fastening free from play of the plug system on the transmission wall, here, the same as in the plug systems at present customary for automatic transmissions of motor vehicles, the socket is situated in the transmission housing in a place in which problems occur predetermined as result of the narrow installation space in the Cardan tunnel and the high temperatures that generate here due to the exhaust system.

The problem to be solved by this invention is to provide an electric plug system for automatic transmissions of motor vehicles which eliminates the problems associated with the small installation space and the high temperatures generated by the exhaust system, which is more accessible than the conventional plug systems and which is adequate as standard interface for the electric connection of the transmission with the control system in the motor vehicle for all types of vehicles known.

SUMMARY OF THE INVENTION

It is also provided according to the invention that the plug system consisting of a socket situated in the transmission and of a plug engaging in the socket be constructed as follows:

the bore is provided in the oil pan and has on its upper outer edge a conical chamfer while in its underside is provided with an annular collar;

the socket is provided on its end facing the interior of the transmission with a radial flange having an outer diameter larger than the diameter of the bore in the oil pan and substantially equal to the outer diameter of the annular collar;

to the flange attaches a cylindrical segment having an outer diameter substantially equal to the diameter of the bore, there being provided in this segment an annular groove in which a seal engages;

to the cylindrical section attaches a cylindrical end that penetrates the bore and projects out of it, there being provided on the outer wall of the cylindrical end two locking gates opposite each other and each forming a guideway;

the cylindrical end and the cylindrical segment are surrounded by a centering sleeve having an outer diameter substantially equal to the diameter of the bore, the centering sleeve being provided on its outer side with an annular groove in which a seal engages;

the centering sleeve is provided with a locking clamp tiltably supported on it and having two guide pilots which interact with the locking gate on the cylindrical end and the locking clamp acts together with a fixing device provided on the outer side of the oil pan.

The inventive electric plug system essentially refers to the design of the socket, which is placed in the oil pan and is in direct communication with the electronic transmission control within the transmission, offers the advantage of a simple construction at reasonable cost and an assembly without problem. The placing on the oil pan instead of on the transmission wall makes possible access without problem and protects it against unacceptable temperature increases.

BRIEF DESCRIPTION OF THE DRAWING(S)

Figure 2:
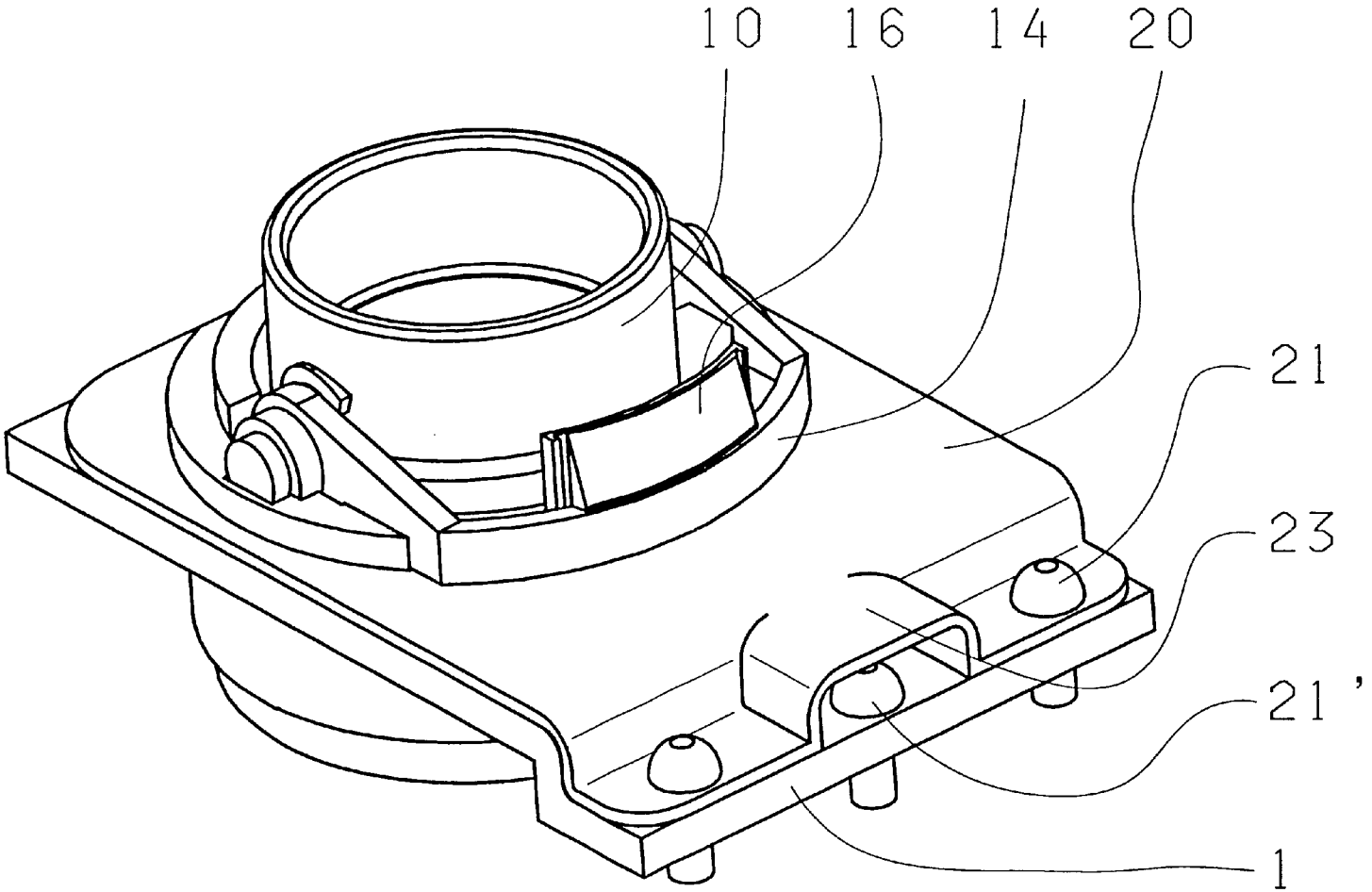
Figures 3A, 3B:
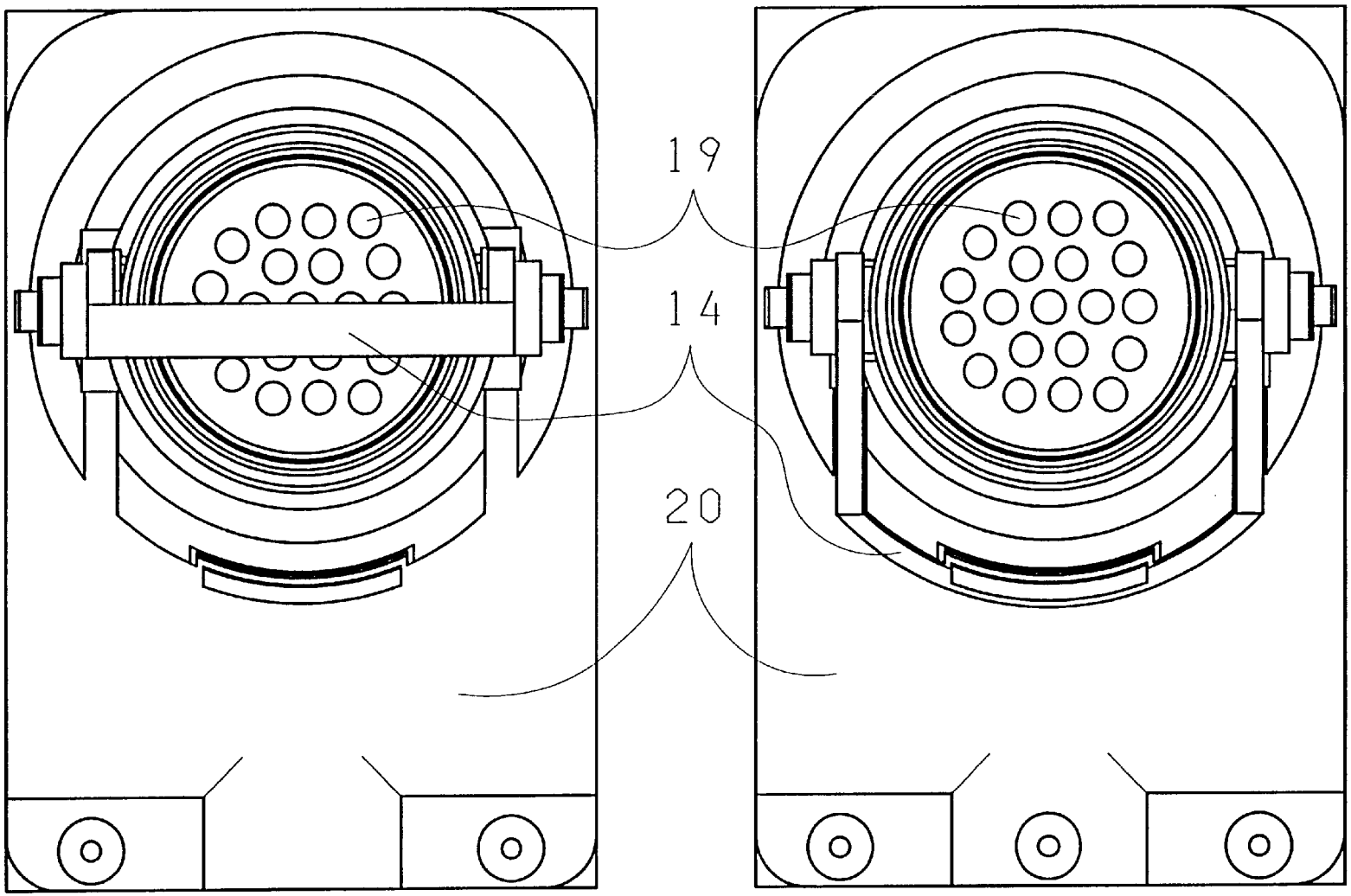
Figure 4A:
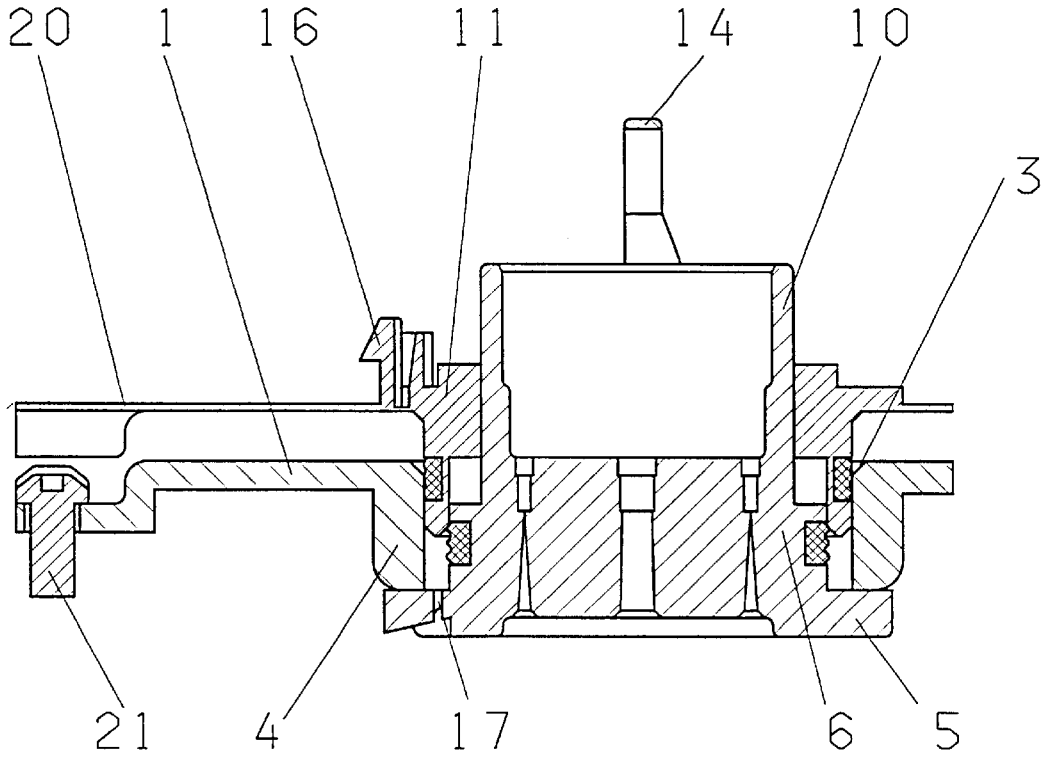
Figure 4B:
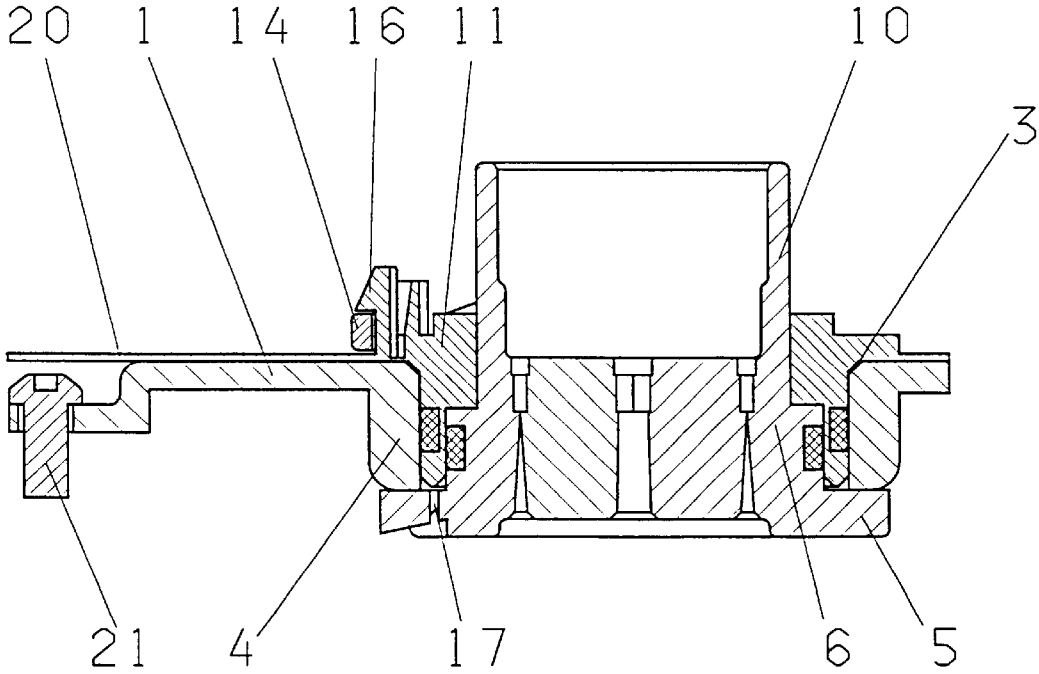
Figure 5A:
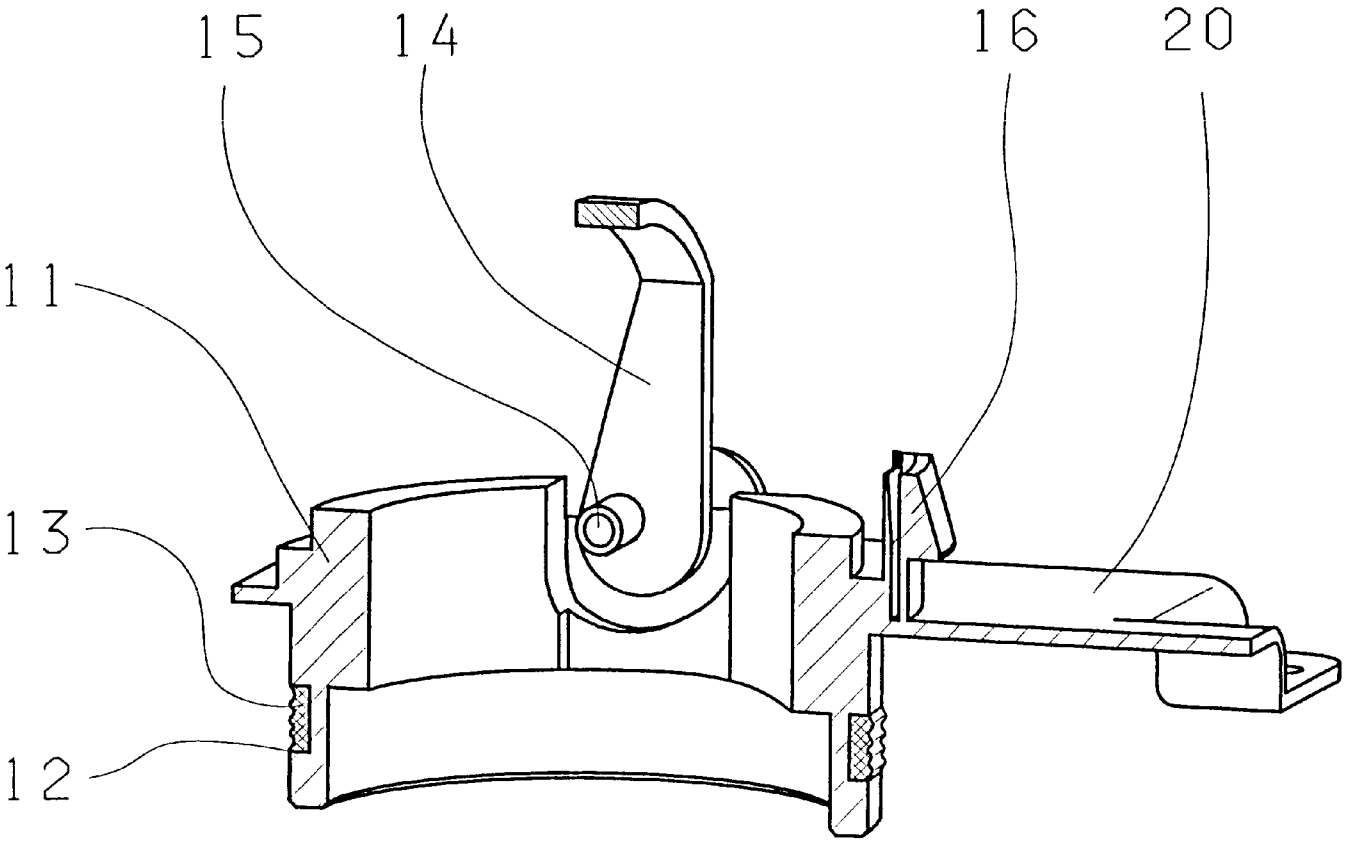
Figure 5B:
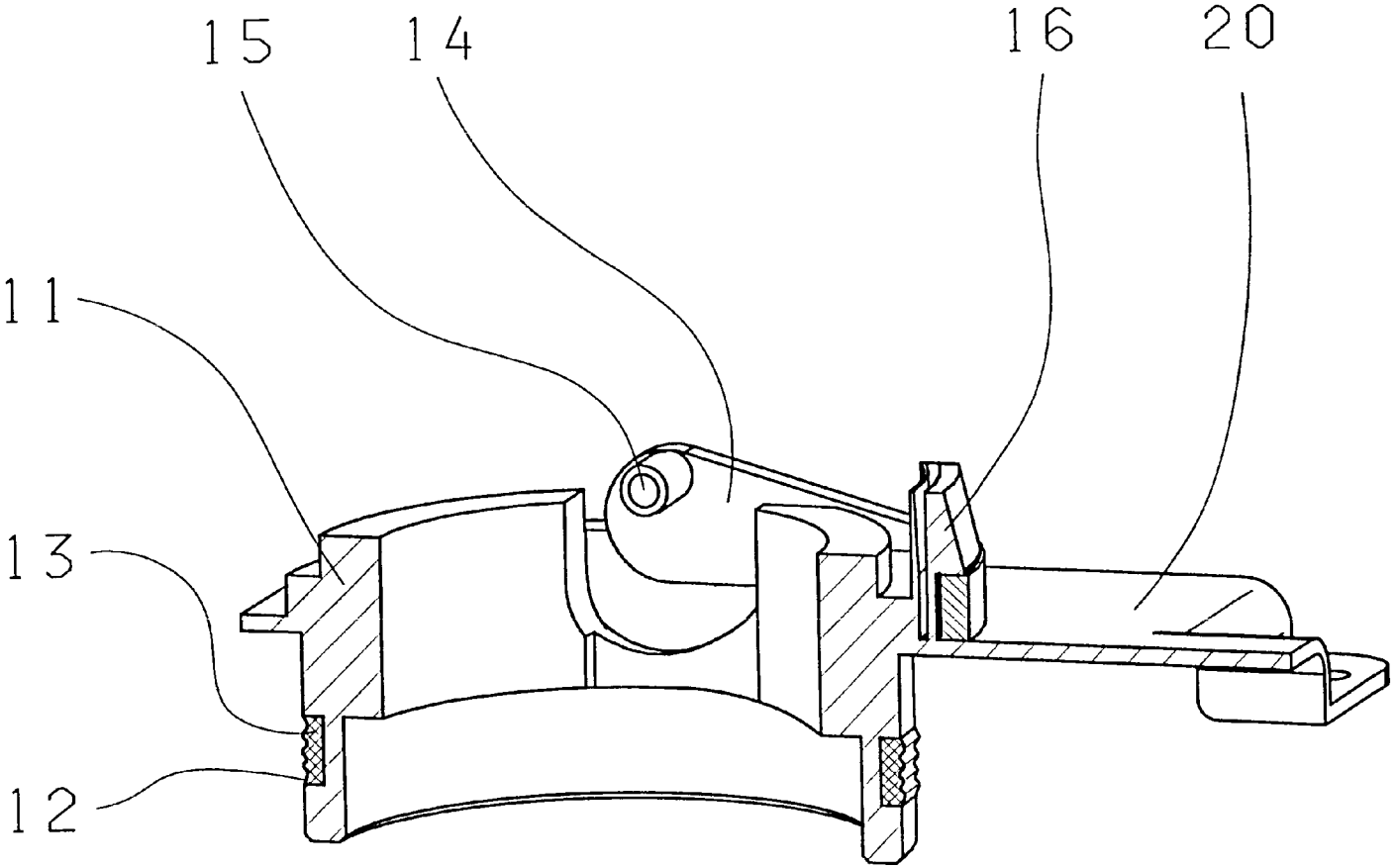
Figure 6A:
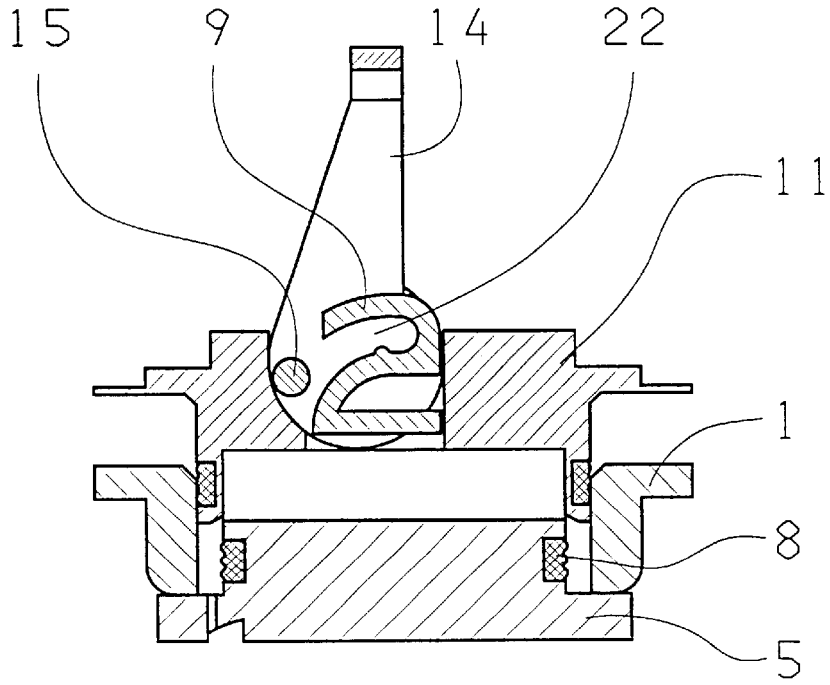
Figure 6B:
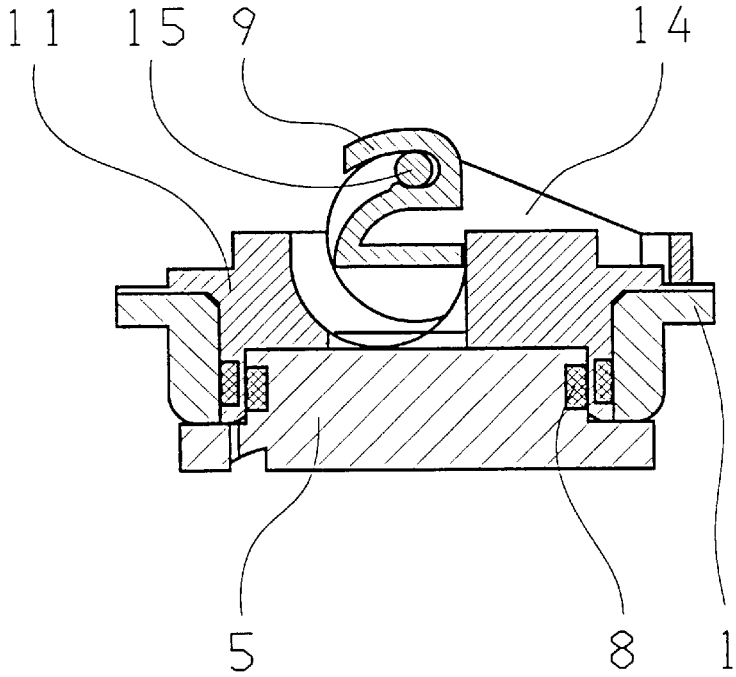

The invention is explained in detail herebelow with reference to the drawing in which an advantageous embodiment is shown. In the drawing:

FIG. 1 is an exploded representation of the separate parts and the coordination thereof in the area of the oil pan of an automatic transmission;

FIG. 2 said parts in assembled state;

FIG. 3*a* is a top view on the plug system with assembled locking clamp;

FIG. 3*b* is a top view with collapsed locking clamp;

FIG. 4*a* is a section through the socket connection, with assembly locking clamp;

FIG. 4*b* is a section with collapsed locking clamp;

FIG. 5*a* is a side view partly in perspective of a cut open plug systems shown assembled;

FIG. 5*b* is a side view partly in perspective of a cut open plug with collapsed locking clamp;

FIG. 6*a* is a partly cut out view of a plug system before assemblage with assembled locking clamp; and FIG. 6*b* is a partly cut out view of a plug system in installed state with collapsed locking clamp.

In the figures the same parts have been provided with the same numerals.

DETAILED DESCRIPTION OF THE INVENTION

In the exploded drawing shown in FIG. 1 one part of the oil pan is designated with 1 and with 2 is designated a cylindrical bore provided in the oil pan which on its upper end is provided with a conical chamfer 3. With 4 is designated an annular collar attaching to the underside of the bore.

The socket to be introduced in the bore 2 has on its side facing the interior of the transmission an annular radial flange 5 having an outer diameter larger than the diameter of the bore 2 in the oil pan 1 and substantially equal to the outer diameter of the annular collar 4. To the flange 5 attaches a cylindrical section 6 having the outer diameter substantially equal to the diameter off the bore 2, there being provided in this cylindrical segment an annular groove 7 in which a seal 9 engages.

The socket to be introduced in the bore 2 has on its side facing the interior of the transmission an annular radial flange 5 having an outer diameter larger than the diameter of the bore 2 in the oil pan 1 and substantially equal to the outer diameter of the annular collar 4. To the flange 5 attaches a cylindrical segment 6 having its outer diameter substantially equal to the diameter of the bore 2, there being provided in this cylindrical segment an annular groove 7 in which a seal 8 engages.

What is claimed is:

1. An electric plug system for an automatic transmission of a motor vehicle comprising a socket situated in the transmission and of a plug engaging in the socket for creating a connection between the electronic control device situated in the transmission and electric feed-in lines integrated in a cable harness wherein the cylindrical end of the socket that accommodates the plug traverses a bore in the transmission and is held by a detachable locking system, wherein a) a bore (2) is provided in said oil pan (1), the bore (2) having on its upper outer edge a conical chamfer (3) and on its underside an annular collar (4);

b) said socket has on an end facing the interior of the transmission, a radial flange. (5) having an outer diameter larger than the diameter of said bore (2) in said oil pan (1) and substantially equal to the outer diameter of said annular collar (4);

c) said radial flange (5) is attached to a cylindrical segment (6) having an outer diameter substantially equal to the diameter of said bore (2), said segment being provided with an annular groove (7) in which a seal (8) is seated;

d) the cylindrical segment (6) is attached to a cylindrical end (10), an outer wall of the part of said cylindrical end (10) traverses said bore (3) and projects out of it, two locking gates (9) are provided which are opposite each other and each forms a guideway (22);

e) said cylindrical end (10) and said cylindrical segment (6) are surrounded by a centering sleeve (11) having its outer diameter substantially equal to the diameter of said bore (2) and that said centering sleeve (11) is provided on its outer side with an annular groove (12) in which a seal (13) is seated;

f) said centering sleeve (11) is provided with a locking clamp (14) tiltably supported on said sleeve and having two guide pilots (15) that interact with said locking gates (10) on said cylindrical end (10); and g) said locking clamp (14) interacts with affixing device (16) provide[0084] o[008e] th[0085] outer side of said oil pan (1).

2. The plug system according to claim 1, wherein said centering sleeve (11) is provided with an extending piece (20) which extends at least up to a fastening screw (21) for said oil pan.

3. The plug system according to claim 1, wherein said lengthening piece (20) is shaped so as to cover via a fishplate at least one fastening screw (21') for said oil pan in the assembled state of said socket.

4. The plug system according to claim 1, wherein within said radial flange (5) is provided with a vent hole (17).

5. The plug system according to claim 1, wherein said radial flange is provided with a plurality tolerance compensating cams (18) on its upper side abutting on the underside of said collar (4) of said oil pan (1).

6. The plug system according to claim 1, wherein said guideways (22) of said locking gates (9) have the shape of a two.

7. The plug system according to claim 1, wherein said fixing device (16) is a detent for said locking clamp (14).

8. The plug system according to claim 1, wherein said fixing device (16) for said locking clamp (14) is a spring member.

* * * * *